US005144769A

United States Patent [19]

Koura

[11] Patent Number: 5,144,769

[45] Date of Patent: Sep. 8, 1992

[54] AUTOMATIC DOOR OPERATING SYSTEM

[75] Inventor: Soushichi Koura, Yokohama, Japan

[73] Assignee: Ohi Seisakusho Co., Ltd., Yokohama, Japan

[21] Appl. No.: 618,416

[22] Filed: Nov. 27, 1990

[30] Foreign Application Priority Data

Nov. 27, 1989 [JP] Japan ..... 1-136085[U]

[51] Int. Cl.[5] ..... E05F 11/00

[52] U.S. Cl. ..... 49/360

[58] Field of Search ..... 49/139, 280, 324, 360

[56] References Cited

U.S. PATENT DOCUMENTS

| | | | |
|---|---|---|---|
| 4,462,185 | 7/1984 | Shibuki et al. | 49/360 X |
| 4,617,757 | 10/1986 | Kagiyama et al. | 49/360 X |
| 4,640,050 | 2/1987 | Yamagishi et al. | 49/360 X |
| 4,862,640 | 9/1989 | Boyko et al. | 49/213 |
| 4,887,390 | 12/1989 | Boyko et al. | 49/360 X |
| 4,916,861 | 4/1990 | Schap | 49/360 X |
| 4,932,715 | 6/1990 | Kramer | 49/360 X |
| 4,945,677 | 8/1990 | Kramer | 49/139 X |
| 4,984,385 | 1/1991 | DeLand | 49/280 |

*Primary Examiner*—Renee S. Luebke
*Assistant Examiner*—Jerry Redman
*Attorney, Agent, or Firm*—Foley & Lardner

[57] ABSTRACT

An automatic door operating system for a motor vehicle is shown. The system comprises a reversible electric motor for moving the door in one or the other direction upon energization thereof, said motor being connected to said door in such a manner that the movement of said door induces a rotation of said motor; a control device for controlling operation of the motor; a door opening control switch connected to the control device, the door opening control switch, when closed, operating the motor to run in a direction to move the door in a door opening direction; a door-open detecting switch connected to said control device, the door-open detecting switch, when the door comes to a full-open position stopping electric feeding to the motor even when said door opening control switch is closed, wherein the control device comprises a motor drive circuit which has the motor connected thereto, the motor drive circuit forming an open circuit when the door opening control switch is opened and electric feeding to the motor stops, but forming a closed circuit when the door opening control switch is closed and the door-open detecting switch detects the full-open condition of said door. With this system, manual movement of the door can be smoothly carried out because the rotation of a rotor of the motor, which is caused by the movement of the door, does not generate electric power which produces a considerable resistance to the movement of the door.

9 Claims, 2 Drawing Sheets

AUTOMATIC DOOR OPERATING SYSTEM

BACKGROUND OF THE INVENTION

1. Field of the Invention

The present invention relates to automatic slide door operating systems in which the opening and closing movement of the door is carried out with the aid of a power device upon manipulation of a control switch. More specifically, the present invention is concerned with the automatic slide door operating systems of a type which permits manual movement of the door under failure of the automatic operating system.

2. Description of the Prior Art

Hitherto, in motor vehicle, particularly, in so-called "one-box" type motor vehicles having slide doors, various types of automatic door operating systems have been proposed and put into practical use for opening and closing the door with the aid of a power device. One of such systems is disclosed in U.S. patent application Ser. No. 07/526,653 filed on May 22, 1990 now U.S. Pat. No. 5,018,303 in the names of Soushichi KOURA et al.

The system described in the prior patent comprises a drive cable which has a part fixed to the door and has a linear part extending along the guide way for the door, a drive drum which is mounted on the vehicle body and has both ends of the drive cable wound therearound, a reversible electric motor which drives the drive drum in one or the other direction upon energization, an open-close control switch which is mounted near a driver's seat for controlling the motor and a door open detecting switch which, upon full opening of the door, breaks the electric feeding to the motor.

The system further comprises a so-called "fail-safe" means which permits manual movement of the door under failure of the automatic door operating system. Under manual movement of the door, the rotor of the electric motor then deenergized is forced to rotate by the drive cable moved with the door.

However, the system has the following drawback due to its inherent construction.

That is, under failure of the automatic door operating system, there is produced a closed circuit which includes the electric motor and the door open detecting switch. Thus, the manual movement of the door, which forces the rotor of the motor to rotate, causes the motor to generate electric power thereby producing a considerable resistance to the movement of the door. Thus, under this condition, smooth manual movement of the door is not obtained.

One of methods to eliminate the above-mentioned drawback is to open the closed circuit under failure of the automatic door operating system.

However, this method brings about the following new drawback.

That is, when, with the motor vehicle parking on a sloping road with its front portion sloped down, the slide door is moved up obliquely to the full-open position by the automatic operating system, the door open detecting switch automatically functions to break or open the closed circuit Thus, under this condition, the door tends to slide obliquely downward by its own weight because the rotation of the rotor of the electric motor does not produce any resistance to the movement of the door.

SUMMARY OF THE INVENTION

It is therefore an object of the present invention to provide an automatic door operating system which is free of the above-mentioned drawbacks.

According to the present invention, there is provided an automatic door operating system for use in a motor vehicle having a vehicle body and a sliding door. The system comprises a reversible electric motor for moving the door in one or the other direction upon energization thereof; a control device for controlling operation of the motor said motor being connected to said door in such a manner that the movement of said door induces a rotation of said motor; a door opening control switch connected to the control device, the door opening control switch, when closed, operating the motor to run in a direction to move the door in a door opening direction; a door-open detecting switch connected to said control device, the door-open detecting switch, when the door comes to a full-open position, stopping electric feeding to the motor even when said door opening control switch is closed, wherein the control device comprises a motor drive circuit which has the motor connected thereto, the motor drive circuit forming an open circuit when the door opening control switch is opened and electric feeding to the motor stops, but formed a closed circuit when the door opening control switch is closed and the door-open detecting switch detects the full-open condition of said door.

DETAILED DESCRIPTION OF THE DRAWINGS

Figure 1:
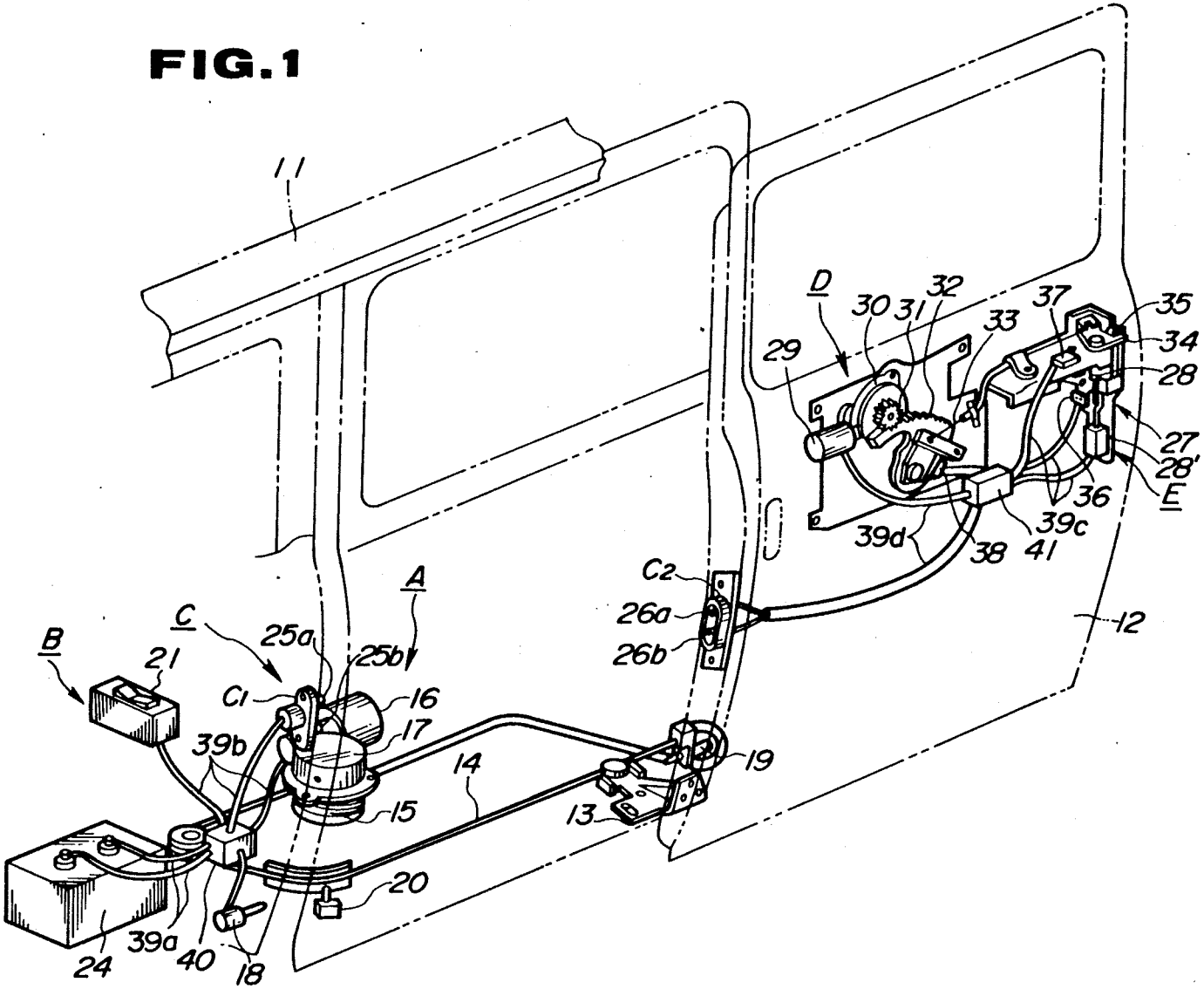
Figure 2:
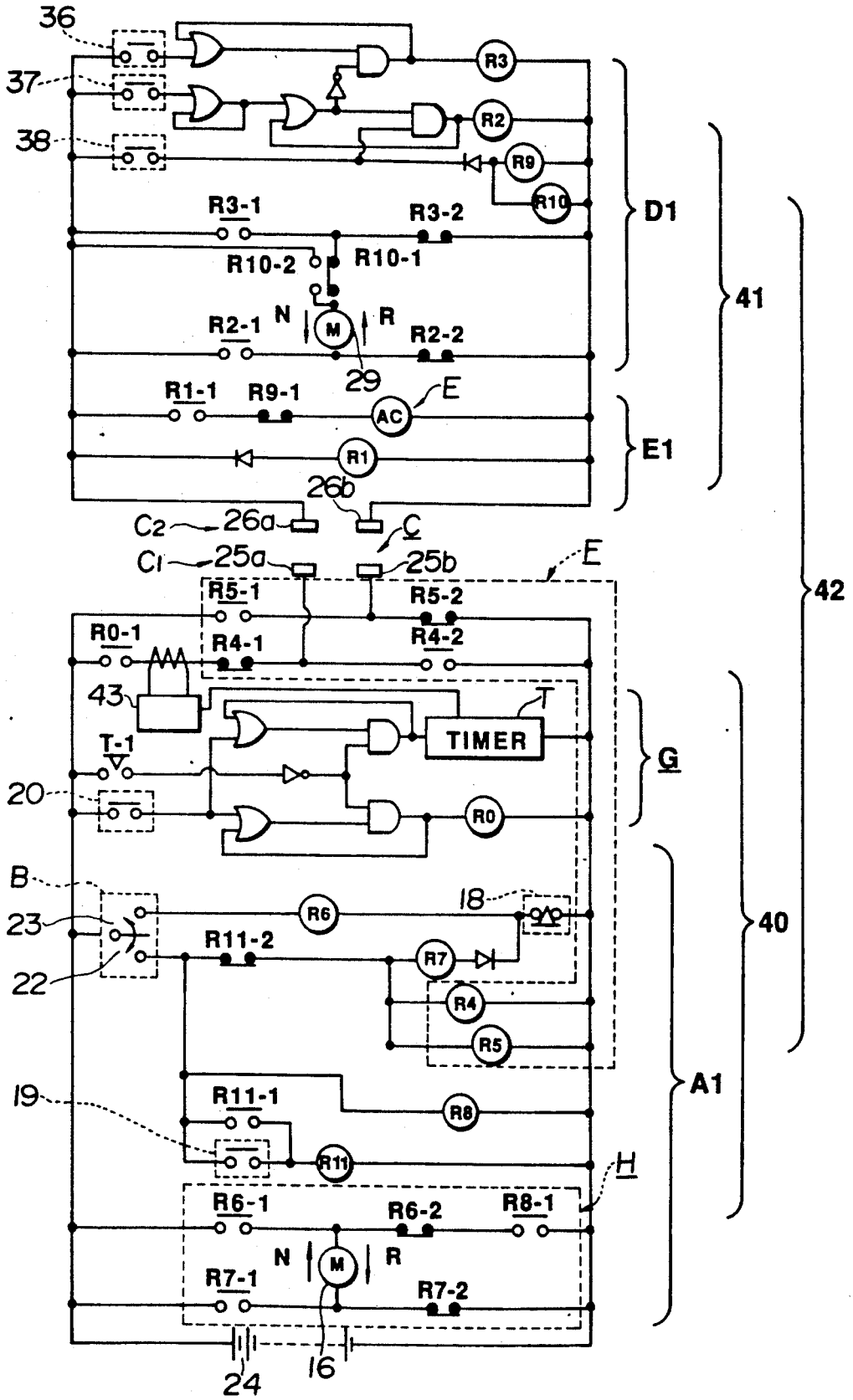

Other objects and advantages of the present invention will become apparent from the following description when taken in conjunction with the accompanying drawings, in which:

FIG. 1 is a perspective view of a power slide door to which the present invention is applied; and FIG. 2 is a control circuit employed in the present invention.

DETAILED DESCRIPTION OF THE INVENTION

Referring to FIG. 1, there is shown a power slide door of a motor vehicle, to which the present invention is applied.

In the drawings, denoted by numeral 11 is a vehicle body, and denoted by numeral 12 is a slide door. Although not shown in the drawings, a known door guide structure is employed by which a guide way for the door 12 is defined. That is, under door opening operation, the door 12 in the full-close position is shifted laterally outward and then moved rearward toward the full-open position. The movement of the door 12 from the full-open position to the full-close position is carried out by travelling the same way in a reversed manner.

As is shown in the drawing, at a lower portion of the vehicle body 11, there is arranged a door moving device "A" by which the door 12 is driven between the full-closed position (more specifically, a position very near the full-closed position) and the full-open position travelling the guide way defined by the door guide structure.

The door moving device A comprises a bracket 13 which is secured to a lower front portion of the door 12. The bracket 13 has a drive cable 14 fixed thereto, which cable has a linear part extending along the guide way for the door 12. The cable 14 has both end portions wound around a drive drum 15. The drum 15 is driven by a reversible electric motor 16 through a speed reduction gear 17. Thus, upon energization of the motor 16, the drive drum 15 is rotated in one or the other direction to move the slide door 12 in the opening or closing direction along the door guide way.

The door moving device A is controlled by a door-closed detecting switch 18 and a door-open detecting switch 19. The door-closed detecting switch 18 is of a normally closed type, which is mounted on the vehicle body and turned OFF when the door 12 assumes a position between the full-closed position and an after-mentioned half-latch position. For this operation, the switch 18 has an antenna pin which is contactable with a front end of the door 12. The door-open detecting switch 19 is of a normally open type, which is mounted on the vehicle body 11 and turned ON when the door 12 comes to the full-open position. For this operation, the switch 19 has an antenna pin which is contactable with a rear end of the bracket 13 of the door 12.

It is to be noted that the door is movable by manual operation. When, upon deenergization of the automatic door operating system, the door 12 is manually moved, the drive cable 14 is moved and thus a rotor of the electric motor 16 is forced to rotate through the drum 15 and the speed reduction gear 17.

The vehicle body 11 has a so-called "feeding start position detecting switch" 20 mounted thereto. The switch 20 is of a normally open type and so constructed as to close for a moment only when the front end of the slide door 12, during its closing movement, passes by a so-called "feeding start position" which is near a so-called "half-latch available position" where the door 12 can assume an after-mentioned "half-latch" position. It is to be noted that when the door 12 comes to the feeding start position, there is defined a small clearance between the front end of the door 12 and a front end of the door opening, which clearance is so sized as not to permit insertion of an operator's hand thereinto. More specifically, the clearance is somewhat larger than a clearance which is defined when the door 12 assumes the half-latch available position.

Designated by reference B is a control device which is mounted on the vehicle body 11 at a position near the driver's seat. The control device B comprises a seesaw type button switch 21.

As will be seen in FIG. 2, the button switch 21 comprises one movable contact and two stationary contacts. The movable contact and one stationary contact constitute a so-called "door opening control switch" 22, while, the movable contact and the other stationary contact constitute a so-called "door closing control switch" 23. When the button is pivoted in one direction, the switch 22 is closed, and, when the button is pivoted in the other direction, the other switch 23 is closed Referring back to FIG. 1, designated by numeral 24 is a battery which serves as an electric power source Designated by reference C is an electric connector which comprises mutually engageable first and second connector parts C1 and C2 each including two axially movable contact pins 25*a* and 25*b* (or 26*a* and 26*b*). Each contact pin is biased to project outward by a spring associated therewith.

The first connector part C1 is mounted on a front end of the door opening having the contact pins 25*a* and 25*b* directed rearward and the second connector part C2 is mounted on the front end of the slide door 12 having the contact pins 26*a* and 26*b* directed forward The first and second connector parts C1 and C2 engage to establish an electric connection therebetween when the door 12 closes. More specifically, when the slide door 12 assumes a position between the feeding start position and the full-close position, the contact pins 25*a* and 25*b* of the first connector part C1 and the corresponding pins 26*a* and 26*b* of the second connector part C2 are mated. Thus, under this condition, electric power is fed from the battery 24 on the vehicle body 11 to the after-mentioned electric devices in the slide door 12.

The contact pins 25*a* and 25*b* of the first connector part C1, the motor 16, the door-close detecting switch 18, the door-open detecting switch 19, the control device B, the feeding start position detecting switch 20 and the battery 24 are connected through suitable lead wires 39*a* and 39*b* to a body-mounted control unit 40.

Within the slide door 12, there is mounted a door closing device D which functions to shift the door 12 from the half-latch position to the full-closed position.

As will be described in detail hereinafter, when the door 12 comes to the half-latch available position, a latch pawl (not shown) of a door lock device 27 becomes incompletely or halfly engaged with a striker (not shown) secured to the vehicle body 11, and thereafter, due to the work of the door closing device D, the latch pawl is forced to turn to achieve a complete latched engagement with the striker forcedly shifting the door 12 to the full-closed position.

Within the door 12, there is further mounted a latch cancelling device E which, upon energization, cancels the latched condition of the slide door 12 in the full-closed position. For achieving this cancelling operation, the device E has an open lever 28 incorporated with the door lock device 27 and a solenoid-spring combination type actuator 28' which is incorporated with the open lever 28. That is, upon energization of the actuator 28', the open lever 28 is pulled in a direction to cancel the latched condition of the door lock device 27. Upon this, the slide door 12 becomes unlatched and the opening movement of the door 12 is available.

The door closing device D is disclosed in U.S. patent application Ser. No. 07/287,277 file Dec. 21, 1988 in the names of Jun YAMAGISHI et al.

The device D comprises a reversible electric motor 29, a speed reduction gear 30 driven by the motor 29, a pinion 31 driven by an output shaft of the reduction gear 30 and a sector gear 32 meshed with and driven by the pinion 31.

When the motor 29 is energized to run in a normal direction, the sector gear 32 pivots in a counterclockwise direction in FIG. 1 thereby pulling a cable 33 which leads to a close lever 34. With this movement, the close lever 34 is pivoted to turn the latch pawl of the door lock device 27 to the full-latch position. With this, the slide door 12 is forced to shift from the half-latch position to the full-closed position. Designated by numeral 35 is an arm possessed by the latch pawl, against which the close lever 34 actually abuts for the movement of the latch pawl.

When, the motor 29 is energized to run in a reversed direction, the sector gear 32 and, thus, the close lever 34 are moved in the opposite directions and are returned to their original positions. The close lever 34 stops at a position remote from the arm 35 of the latch pawl. It is to be noted that under this condition, the full-closed condition of the door 12 is kept unchanged.

Designated by numeral 36 is a half-latch detecting switch mounted to the door lock device 27, which functions to detect the arrival of the door 12 to the half-latch available position. That is, the switch 36 is turned ON when, upon abutment of the striker against the latch pawl due to arrival of the door 12 to the half-latch available position, the open lever 28 is slightly turned in the lock cancelling direction.

Designated by numeral 37 is a full-latch detecting switch which is mounted to the door lock device 27. The switch 37 functions to detect the fully-latched condition of the door lock device 27. That is, the switch 37 is turned ON when the close lever 34 abuts on the switch 37 turning the latch pawl to the fully-latched position.

Designated by numeral 38 is a so-called "return recognition switch" which detects whether the sector gear 32 has returned to a rest position or not. The switch 38 is kept OFF when the sector gear 32 is in the rest position as shown in FIG. 1, but turned ON when the sector gear 32 is pivoted away from the rest position.

The motor 29, the half-latch detecting switch 36, the full-latch detecting switch 37, the return recognition switch 38 and the actuator 28' are connected through suitable lead wires 39*c* to a door-mounted control unit 41. The contact pins 26*a* and 26*b* of the second connector part C2 are connected to the control unit 41 through lead wires 39*d*, as shown.

FIG. 2 shows a control circuit 42 employed for controlling the movement of the slide door 12.

The control circuit 42 comprises generally the body-mounted control unit 40 and the door-mounted control unit 41.

The body-mounted control unit 40 comprises a control device A1 which controls the door moving device A, a positive/negative switching device F which switches the polarity of electric power fed to the contact pins 25*a* and 25*b* of the first connector part C1 in response to operation of the control device B, and a time-counting device G which controls, by using a timer T, the time for electric power feeding during closing movement of the door 12.

The control device A1 is equipped with a motor drive circuit H which controls the direction in which the motor 16 runs.

The door-mounted control unit 41 comprises a control device D1 which controls the door closing device D and a control device E1 which controls the latch cancelling device E.

Denoted by references R0, R1, . . . R77 are relays, R0-1, R1-1, . . . R11-2 are contacts of the relays, T1 is a timer contact of the timer T, and denoted by numeral 43 is a current detector which resets the timer T1 when detecting that a predetermined current sufficient for operating the motor 29 flows through a series circuit which includes the contacts R0-1 and R4-2. The current detector 43 thus serves to detect the operation of the door closing device D. AND gates, OR gates, inverters and diodes are arranged in the illustrated manner.

As is shown in FIG. 2, the control circuit 42 has a relay R8 connected to the door opening control switch 22 of the control device B. In the motor drive circuit H, a normally open contact R8-1 of the relay R8 is connected in series with a normally closed contact R6-2 of a relay R6 which is connected to the door closing control switch 23.

Thus, when the door opening control switch 22 is OFF, the motor drive circuit H is kept open by the normally open contact R8-1.

In the following, operation of the automatic door operating system of the invention will be described with reference to FIGS. 1 and 2.

For ease of understanding, the description will be commenced with respect to the full-closed condition of the slide door 12. Under this condition, the first and second connector parts C1 and C2 are coupled, the control device B assumes a neutral position (viz., the switches 22 and 23 are kept OFF), the door-close detecting switch 18 is opened, the full-latch detecting switch 37 is closed, the normally open contacts and switches are all opened, the normally closed contacts and switches are all closed and the relays are all deenergized.

When the door opening control switch 22 of the control device B is closed by, for example, a driver in the vehicle, the relays R4, R5 and R8 are simultaneously energized. Upon this, normally open contacts R4-2, R5-1 and R8-1 are closed and the normally closed contacts R4-1 and R5-2 are opened. Thus, the electric power feeding to the electric connector C becomes available having the contact pins 25*a* and 25*b* charged negative and positive respectively.

Because the first and second connector parts C1 and C2 are kept coupled, the electric power is applied to the door-mounted control unit 41. Thus, a circuit consisting of the contact 25*b*, the relay R1, the diode (no numeral) and the contact 25*a* becomes complete thereby energizing the relay R1.

Upon this, the contact R1-1 is closed and thus the latch cancelling device E energized. Thus, the open lever 28 of the door lock device 27 is turned in a direction to cancel the latched condition of the door 12, and thus the door 12 is forced to shift to the half-latch available position due to the biasing force produced by the elastomeric door seal.

The door-close detecting switch 18 is then closed thereby energizing the relay R7. With this, the contact R7-1 is closed and the contact R7-2 is opened. Because, under this condition, the contact R8-1 is kept closed, a circuit including the contact R7-1, the motor 16, the contact R6-2 and the contact R8-1 becomes complete thereby causing the motor 16 to run in a normal direction.

Due to the running of the motor 16 in the normal direction, the door 12 starts to move in the door opening direction. The door 12 starts to be driven by the door moving device A.

When the door 12 passes by the "feeding start position", the second connector part C2 on the door 12 is disconnected from the first connector part C1 on the vehicle body 11 stopping the electric feeding to the electric devices in the door 12. Thus, the relay R1 is deenergized, the operation of the actuator 28' of the latch cancelling device E stops, and thus, the open lever 28 is returned to its original rest position.

When the door 12 is moved to the full-open position due to continuous operation of the door moving device A, the door-open detecting switch 19 is closed.

With the door opening control switch 22 being kept closed, the relay R11 becomes energized thereby closing the normally open contact R11-1 and opening the normally closed contact R11-2, so that the relays R7, R4 and R5 are all deenergized at the same time causing their contacts to return to their original positions. Thus, the motor 16 becomes deenergized and the electric power circuit leading from the battery 24 to the first connector part C1 is opened.

When the door opening control switch 22 is kept closed upon the deenergization of the motor 16, the normally open contact R8-1 is closed and thus a circuit including the motor 16, the contact R7-2, the contact R8-1 and the contact R6-2 is closed.

It is to be noted that this closed condition of the circuit is advantageous because the rotation of the rotor of the motor 16, which is caused by the free movement of the door 12, can generate electric power to resist the free movement of the door 12. That is, even when, with the motor vehicle parking on a slope, the power feeding to the motor 16 stops upon full opening of the door 12, rapid closing movement of the door 12 due to its own weight does not occur because of the resistance created by the door opening control switch 22 being kept closed.

When the door closing control switch 23 is closed, the relay R6 becomes energized.

Upon energization of the relay R6, the contact R6-1 is closed and the other contact R6-2 is opened, and a circuit including the contact R6-1, the motor 16 and the contact R7-2 is completed. Thus, the motor 16 is energized to run in a reversed direction.

Thus, the door 12 is moved in the closing direction.

When the door 12 comes to the "feeding start position", the second connector part C2 of the door 12 is brought into engagement with the first connector part C1 of the vehicle body 11, and at the same time, the feeding start position detecting switch 20 is closed for a moment.

Upon this, the relay R0 and the timer T are energized and brought to their self-holding conditions.

When, due to energization of the relay R0, the contact R0-1 is closed, the contact pin 25*a* of the first connector part C1 is connected through the contacts R0-1 and R4-1 to the positive terminal of the battery 24, and the other contact pin 25*b* is connected through the contact R5-2 to the negative terminal of the battery 24. Thus, a circuit from the battery 24 to the electric connector C is completed in such a manner that the contact pins 25*a* and 25*b* are charged positive and negative respectively, unlike the above-mentioned case wherein the door 12 is being opened.

The timer T is so constructed that when a predetermined time (for example, ten seconds) passes after energization thereof, the timer contact T1 is closed.

When, due to the presence of a foreign thing accidentally caught between the door 12 and the vehicle body 11, the door 12 is forced to stop at a position between the feeding start position and the half-latch available position and the predetermined time passes, the timer contact T1 is closed and thus the relay R0 is deenergized Thus, electric power feeding toward the electric connector C stops and electric power feeding to the timer T also stops preventing waste of electric power.

When, after starting of the electric feeding to the door-mounted electric devices, the door 12 is moved to the half-latch available position due to the continuous operation of the door moving device A, the half-latch detecting switch 36 of the control device D1 is closed for a moment. With this, the relay R3 is energized and thus brought to its self-holding condition.

Upon this, the contact R3-1 of the relay R3 is closed and the other contact R3-2 is opened, and a circuit including the contact R3-1, the normally closed contact R10-1, the motor 29 and the contact R2-2 is completed. Thus, the motor 16 is energized to run in a normal direction.

With the rotation of the motor 29 in the normal direction, the sector gear 32 of the door closing device D is pivoted in a counterclockwise direction in FIG. 1. Thus, the cable 33 is pulled leftward turning the close lever 34. With this, the latch pawl of the door lock device 27 is forced to achieve a complete engagement with the striker thereby to shift the door 12 to the full-closed position. It is to be noted that this shifting of the door 12 is achieved by only the door closing device D.

That is, when the sector gear 32 is pivoted slightly in the counterclockwise direction from the rest position, the return recognition switch 38, which has been kept opened, is closed. However, this closing of the switch 38 has no effect on the relays.

When, due to the counterclockwise movement of the sector gear 32, the latch pawl of the door lock device 27 is turned to the full-latch position, the full-latch detecting switch 37 becomes closed thereby deenergizing the relay R3 and energizing the relay R2.

With this, the contacts R3-1 and R2-2 are opened and the contacts R2-1 and R3-2 are closed, so that a circuit including the contact R2-1, the motor 29, the contact R10-1 and the contact R3-2 is completed thereby energizing the motor 29 to run in a reversed direction.

With this reversed operation of the motor 29, the sector gear 32 is pivoted in a clockwise direction in FIG. 1 and returned to the rest position.

When the sector 32 is returned to the rest position, the return recognition switch 38 is closed thereby deenergizing the relay R2. With this, the contact R2-1 is opened and the contact R3-2 is closed, so that electric feeding to the motor 29 stops and thus operation of the motor 29 stops.

When the predetermined time set by the timer T elapses, the relay R0 is deenergized causing the contact R0-1 to open. With this, the electric power feeding toward the electric connector C stops. Thus, the door 12 now assumes the full-closed position which has been described hereinbefore.

In the following, manual movement of the door 12, which may be carried out under failure of the automatic door operating system, will be described.

The manual movement of the door 12 can be smoothly and lightly carried out because, under such condition, the motor drive circuit H does not constitute any closed circuit which includes the motor 16. In fact, when the control device B (viz., seesaw type button switch 21) assumes the neutral position, the relay R8 is deenergized and, thus, the normally open contact R8-1 thereof is opened. This means that any possible circuit which includes the motor 16 fails to take a closed condition. Thus, even when the rotor of the motor 16 is forced to rotate due to the manual movement of the door 12, the motor 16 fails to generate electric power which causes generation of a considerable resistance to the movement of the door 12.

What is claimed is:

1. An automatic door operating system for use in a motor vehicle having a vehicle body and a sliding door, comprising:

a reversible electric motor for moving said door in one or the other direction upon energization thereof, said motor being connected to said door in such a manner that movement of said door includes rotation of said motor;

a control device for controlling operation of said motor;

a door opening control switch connected to said control device, said door opening control switch, when closed, operating said motor to run in a direction to move said door in a door opening direction;

a door-open detecting switch connected to said control device, said door-open detecting switch, when said door comes to a full-open position, preventing the supply of electricity to said motor even when said door opening control switch is closed, such that no electricity is supplied to said motor when said door reaches the full-open position;

wherein said control device comprises a motor drive circuit which has said motor connected thereto, said motor drive circuit forming an open circuit when said door opening control switch is opened and no electricity is supplied to said motor, but forming a closed circuit when said door opening control switch is closed and said door-open detecting switch detects the full-open condition of said door.

2. An automatic door operating system as claimed in claim 1, in which said motor drive circuit comprises a normally open contact of a relay, said relay being connected to said door opening control switch and energized when said door opening control switch is closed.

3. An automatic door operating system as claimed in claim 1, further comprising a door closing control switch connected to said control device, said door closing control device, when closed, operating said motor to run in a direction to move said door in a door closing direction.

4. An automatic door operating system as claimed in claim 3, in which said motor drive circuit comprises:

a battery having positive and negative terminals;

normally open and closed contacts of a first relay, which are connected in series and respectively connected to said positive and negative terminals of said battery, said first relay being connected to said door closing control switch and energized when said door closing control switch is closed;

normally open and closed contacts of a second relay, which are connected in series and respectively connected to said positive and negative terminals of said battery, said second relay being connected to said door opening control switch and energized when said door opening control switch is closed, a normally open contact of a third relay interposed between said normally closed contact of said first relay and said negative terminal of said battery, said third relay being connected to said door opening control switch, wherein said motor has one terminal end connected to a junction portion between said normally open and closed contacts of said first relay and the other terminal end connected to a junction portion between said normally open and closed contacts of said second relay.

5. An automatic door operating system as claimed in claim 4, in which said door-open detecting switch is interposed between said door opening control switch and said negative terminal of said battery.

6. An automatic door operating system as claimed in claim 5, further comprising a door-closed detecting switch which is of a normally closed type and turned OFF when said door assumes a position between a full-closed position and a half-latch position, said door-closed detecting switch being connected in series with said first relay.

7. An automatic door operating system as claimed in claim 6, in which said second relay is connected through a diode to a junction portion between said first relay and said door-closed detecting switch.

8. An automatic door operating system as claimed in claim 7, further comprising normally open and closed contacts of a fourth relay, said normally open contact being connected in parallel with said door-open detecting switch and said normally closed contact being connected in series with said second relay, said fourth relay being connected in series with said door open detecting switch.

9. An automatic door operating system as claimed in claim 8, further comprising means for allowing said door to assume the full-open position, the half-latch position and the full-closed position, said full-open position being a position wherein said door fully opens a door opening defined by said vehicle body, said half-latch position being a position wherein said door is halfly latched to the vehicle body while almost closing said door opening and said full-closed position being a position wherein said door is fully to the vehicle body while fully closing said door opening.

* * * * *